US005769692A

United States Patent [19]

Pasch et al.

[11] Patent Number: 5,769,692

[45] Date of Patent: Jun. 23, 1998

[54] ON THE USE OF NON-SPHERICAL CARRIERS FOR SUBSTRATE CHEMI-MECHANICAL POLISHING

[75] Inventors: Nicholas F. Pasch, Pacifica; David J. Heine, Pleasanton; Jayashree Kalpathy Cramer, Milpitas, all of Calif.

[73] Assignee: LSI Logic Corporation, Milpitas, Calif.

[21] Appl. No.: 772,310

[22] Filed: Dec. 23, 1996

[51] Int. Cl.[6] ..... B24B 13/02

[52] U.S. Cl. ..... 451/41; 451/285; 451/287; 451/289; 451/388; 451/390

[58] Field of Search ..... 451/384, 390, 451/285–290, 41, 56, 388, 398, 42, 364

[56] References Cited

U.S. PATENT DOCUMENTS

| | | | |
|---|---|---|---|
| 4,530,139 | 7/1985 | Miller | 451/390 |
| 4,603,466 | 8/1986 | Morley | 451/388 |
| 5,423,716 | 6/1995 | Strasbaugh | 451/287 |
| 5,441,444 | 8/1995 | Nakajima et al. | 451/289 |
| 5,651,724 | 7/1997 | Kimura et al. | 451/285 |

*Primary Examiner*—Robert A. Rose
*Assistant Examiner*—George Nguyen
*Attorney, Agent, or Firm*—Beyer & Weaver, LLP

[57] ABSTRACT

A substrate holder assembly for immobilizing an integrated circuit (IC) wafer during polishing is described. The substrate holder includes a base plate sized to support the integrated circuit (IC) wafer, a circumferential restraint member arranged with respect to the base plate to engage the IC wafer's edges and a carrier assembly disposed above the base plate and below the IC wafer. The carrier assembly includes a film having a surface that is characterized by a substantially oblate spheroid or hyperboloid surface of rotation, wherein the surface of the film is capable of supporting the IC wafer in a manner causing the IC wafer to bow according to the surface of rotation.

23 Claims, 10 Drawing Sheets

ON THE USE OF NON-SPHERICAL CARRIERS FOR SUBSTRATE CHEMI-MECHANICAL POLISHING

BACKGROUND OF THE INVENTION

The present invention relates to chemi-mechanical polishing for semiconductor substrates. More particularly, the present invention relates to chemi-mechanical polishing of a semiconductor substrate by employing a non-spherical carrier in a substrate holder assembly.

FIG. 1 shows a top view of a typical semiconductor wafer 10 having an active die area 12 and a guardband area 14. Transistor devices, such as metal oxide semiconductor (MOS) transistor devices are primarily located about the center of wafer 10 in die area 12. Guardband area 14 or the "exclusion zone," as it is well known, refers to the periphery or the perimeter area around die area 12 and may also contain a few dies. Guardband area 14, tends to be relatively large, i.e. typically about 1 cm or more from the edge of wafer 10. Unfortunately, this area is not available for die fabrication and therefore constitutes wasted silicon.

FIG. 2 sets forth the side-sectional view of an outer radial section of wafer 10 shown in FIG. 1. Guardband area 14 is typically elevated about 3–5 micrometer ($\mu$m) above die area 12. The difference in the height of die area 12 and guardband area 14 results from material build-up in guardband area 14 during the wafer fabrication process. By way of example, after blanket depositing metallization and insulating layers, such as aluminum and $SiO_2$, across the entire wafer surface, etching or patterning is mainly conducted in the interior regions of the wafer surface. Die area 12, therefore, generally does not experience substantial material build up, while metallization, dielectric and other material layers accumulate in guardband area 14 to form relatively large deposits that remain unetched. FIG. 2 shows an example "step profile," i.e. die area 12, $SiO_2$ area 16 and metallization area 18, of wafer 10.

At one or more points of the wafer fabrication process, the wafer undergoes chemi-mechanical polishing, which is well known in the art. FIG. 3 shows an exploded view of a cross-section of a wafer holder assembly 40 that is typically employed to adequately secure or hold wafer 10 of FIGS. 1 and 2 during wafer polishing. Referring to this figure, wafer holder assembly 40 includes a base plate 48, mounted above which is an annular ring 50, a carrier 46, and a carrier film 44 having a spherically shaped top side.

FIG. 4 is a side-sectional view of wafer 10 mounted on a wafer holder assembly 40, where all the components of assembly 40 are assembled together. According to this figure, base plate 48 and ring 50 appear in substantially the same configuration as shown in FIG. 3. Carrier 46 is placed inside the annular region of ring 50 and covered by carrier film 44. Wafer 10 rests on film 44 and is held at its edges by the comers of ring 50, which is designed to hold and prevent wafer 10 from sliding sideways. In this position, the surface of wafer 10 slightly protrudes beyond the top edge of ring 50 to undergo polishing. Additionally, assembly 40 may also include vacuum holes (not shown to simplify illustration) to ensure that wafer 10 is held tightly against carrier film 44.

Before the wafer is mounted on a wafer holder, the carrier and carrier film described above are typically processed according to steps that are detailed hereinafter. Referring to FIG. 5, which shows a carrier film fixture 52 positioned above an assembly of carrier 46 and carrier film 44'. Fixture 52 includes a concave spherical bow 64, i.e. surface 54 recedes towards its interior. It should be noted that in FIG. 5, bow 64 has been exaggerated for purposes of simplifying illustration. Bow 64 in fixture 52 is actually very subtle, i.e. for a typical length of fixture 52 of between about 6 and about 8 inches, bow 64 is typically no more than about 50 $\mu$m. It is important to recognize that surface 54 is characterized as a spherical surface of rotation, i.e. if a cross section of surface 52 were to revolve about a horizontal axis 42 that is shown as a dashed line in FIG. 5, it would define a substantially spherical area.

As shown in FIG. 6, carrier film 44 is then sandwiched between carrier 46 and fixture 52 under a significant pressure and a high temperature. The surface of carrier film 44 deforms to acquire a shape that conforms to the surface of fixture 52 such that the surface of carrier film 44 protrudes out by a distance that corresponds to the recessed distance of the surface of fixture 52. As a result, the shape of the surface of carrier film 44 may also may be characterized as having a spherical surface of rotation.

FIG. 7 shows wafer 10 disposed above and conforming to the greatly exaggerated surface of carrier film 44. Wafer 10 may be secured on carrier film 44 in this manner by vacuum holes 48, which are connected to a vacuum source (not shown for simplifying illustration). In a subsequent step, wafer 10 undergoes polishing. The bow introduced in wafer 10 is intended to provide a uniformly polished central region (where most of the dies are located) by compensating for the build-up in the periphery of wafer 10 to allow more of the wafer surface to contact a polishing pad. Due to its rigidity, the wafer surface, except for guardband area 14, is kept relatively flat, i.e. it typically deflects no more than about 2000 and about 5000 Angstroms.

Unfortunately polishing by this technique suffers from several drawbacks. By way of example, FIG. 8 shows a poorly polished region 24 just interior to guardband area 14 of wafer 10 that results due to polishing by the above-described technique. Region 24 is formed because the step profile attributed to the build-up, i.e. deposits in $SiO_2$ area 16 and metallization area 18 in guardband area 14, causes a polishing pad 30 to ride up during polishing and thereby exerts a significantly lower polish pressure per square inch in guardband area 14 than in die area 12. As a result, the dies in region 24 may be rendered inoperative.

FIG. 9 shows the top view of the surface of wafer 10 after polishing has concluded. FIGS. 1 and 9 may be compared to illustrate the degradation of the dies in the perimeter of the wafer surface resulting from polishing. The problem of having inoperative dies near the periphery becomes more pronounced as current technology moves from typical die sizes of between about 4 and about 6 mm to die sizes of between about 17 and about 20 mm because the number of dies available in the die area are even more limited.

What is needed is a method and apparatus for effectively polishing a wafer surface without rendering the dies, located in the perimeter of the wafer surface, inoperative.

SUMMARY OF THE INVENTION

To achieve the foregoing, the present invention provides an improved apparatus and method for polishing a wafer surface. In one aspect of the present invention, a substrate holder assembly for immobilizing an integrated circuit (IC) wafer during polishing is described. The substrate holder includes a base plate sized to support the integrated circuit (IC) wafer, a circumferential restraint member arranged with respect to the base plate to engage the IC wafer's edges and a carrier assembly disposed above the base plate and below the IC wafer. The carrier assembly includes a film having a surface that is characterized by a substantially oblate spheroid or hyperboloid surface of rotation, wherein the surface of the film is capable of supporting the IC wafer in a manner causing the IC wafer to bow according to the surface of rotation.

In the substrate holder assembly, the film may include a thermoplastic compressible material, which includes, polyvinyl chloride, polyvinyl acetate and nylon, for example. The substrate holder assembly may further include a plurality of openings that are capable of maintaining a vacuum such that if the substrate contacts the film, the substrate is held tightly enough against the film to bow according to the surface of rotation of the film, wherein the openings extend from the base plate, through the carrier and to the film.

In another aspect of the present invention, a carrier film tool having a surface that is characterized by a substantially oblate-spheroid or hyperboloid surface of rotation is described. The carrier film tool is capable of shaping the surface of a deformable material to produce a film capable of supporting an IC wafer in a wafer holder used to immobilize the IC wafer during polishing. The carrier film tool shapes the film to have a film surface corresponding to the substantially oblate-spheroid or hyperboloid surface of rotation of the carrier film tool.

In yet another aspect of the present invention, a process of forming a film having a surface that is characterized by a substantially oblate-spheroid or hyperboloid surface of rotation is described. The film is capable of supporting an IC wafer in a wafer holder used to immobilize the IC wafer during polishing. The process of forming the film includes: providing a deformable film; bringing the film in contact with a surface of a carrier film tool, wherein the surface of the tool is characterized by a substantially oblate-spheroid or hyperboloid surface of rotation; and applying sufficient pressure on the surface of the tool and against the film such that the surface of the film acquires a shape that corresponds to the surface of rotation of the tool.

The process of forming the film may further include a step of providing the film on a carrier prior to bringing said film in contact, wherein the film may be disposed above the carrier. The process may also include a step of gluing the carrier to the film that comes before the step of providing the film. In the process of forming the film, the step of applying sufficient pressure sandwiches the film between the tool and the carrier. This is accomplished by typically applying a pressure of between about 50 and about 60 psi and maintaining a temperature of between about 150 ° and about 200 ° C.

In yet another aspect of the present invention, a process of polishing a substrate is described. The process of polishing includes mounting the substrate in a substrate holder assembly as described above, and contacting a substrate with a polishing pad against the surface of the substrate to polish the substrate. The substrate holder assembly may hold the substrate such that the substrate is facing down and contacting the polishing pad facing up. In one embodiment, the polishing pad in the present invention contacts the guardband region along the periphery of the substrate along with a die region of the substrate. Alternatively, in another embodiment of the present invention, the polishing pad contacts a die region of the substrate without substantially contacting a guardband region along the periphery of the substrate In yet another aspect of the present invention, a second substrate holder assembly for polishing a substrate used to fabricate one or more ICs is described. This substrate holder assembly includes base plate means for providing support to an IC wafer, means to hold the substrate at the edges disposed above the base plate and a carrier film disposed above base plate means and having a surface that is characterized as a non-spherical surface of rotation, wherein the surface of the film is capable of holding a substrate.

In the second substrate holder assembly, the base plate may include stainless steel, the means to hold may include nylon, the film may include a thermoplastic compressible material, which may include such materials as polyvinyl chloride, polyvinyl acetate and nylon. This substrate holder assembly may further include a carrier means supporting the film and disposed within the means to hold the substrate. The carrier means may include stainless steel and a planar top surface.

These and other features of the present invention will be described in more detail below in the detailed description of the invention and in conjunction with the following figures.

DETAILED DESCRIPTION OF THE PREFERRED EMBODIMENTS

The present invention employs an improved design of a carrier film tool (fixture) that shapes carrier films for use in improved apparatuses and methods for polishing a wafer surface. In the following description, numerous specific details are set forth in order to provide a thorough understanding of the present invention. It will be apparent, however, to one skilled in the art that the present invention may be practiced without limitation to some or all of these specific details.

The present invention employs a carrier film fixture tool having a surface that may be characterized as a non-spherical surface of rotation. Preferably, the non-spherical surface of rotation is a highly polished oblate spheroid or hyperboloid surface of rotation.

Figure 10:
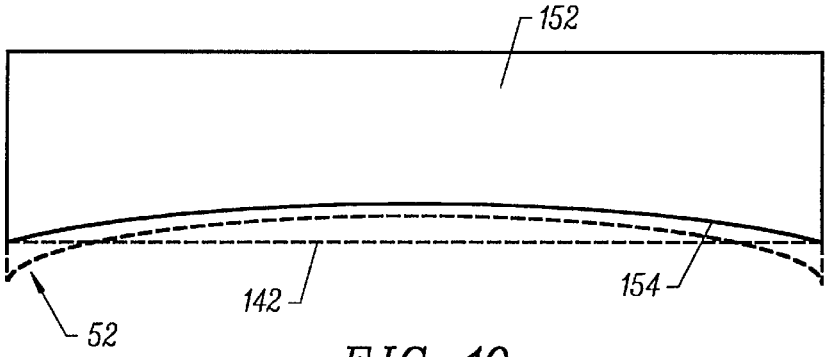
FIG. 10 shows one embodiment of the inventive carrier film fixture having a surface that is characterized as an oblate-spheroid surface of rotation superimposed over a spheroid surface of rotation such as employed in the carrier film fixture of FIG. 5.

By way of example, FIG. 10 shows a carrier film fixture 152, according to one embodiment of the present invention, having a surface 154 that may be characterized as an oblate-spheroid surface of rotation, i.e. if surface 154 were to revolve around a horizontal axis 142, which is shown in FIG. 10 as a dashed line, the surface would span the volume of an oblate-spheroid. In order to appreciate the change in surface geometry offered by fixture 152 relative to the carrier film fixture of the prior art, fixture 152 in FIG. 10 has been superimposed over prior art fixture 52 (also shown in FIG. 5), which is represented by phantom lines and has a surface that may be characterized as a spherical surface of rotation. Note that the oblate spheroid section makes a flatter imprint in tool 152 than the spherical section.

Figure 5:
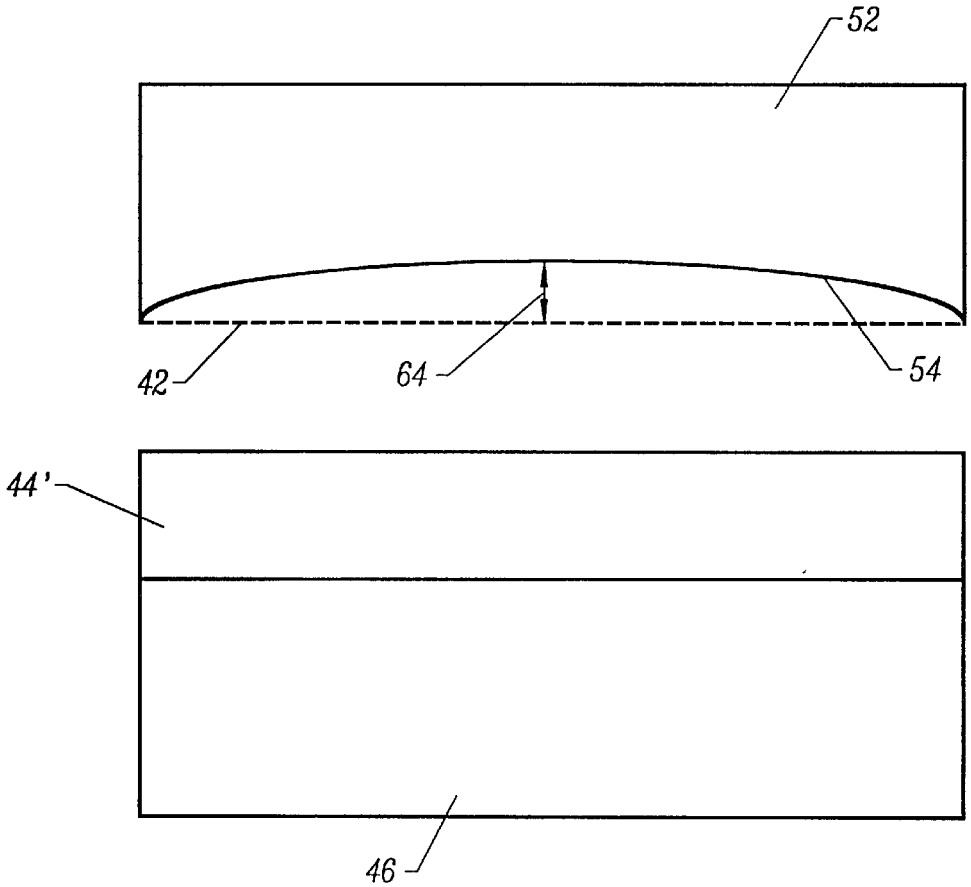
FIG. 5 PRIOR ART
FIG. 5 shows a side-sectional view of a cross-section of a carrier film fixture having a spherical surface of rotation and positioned above an assembly of a carrier and a carrier film.
Figure 6:
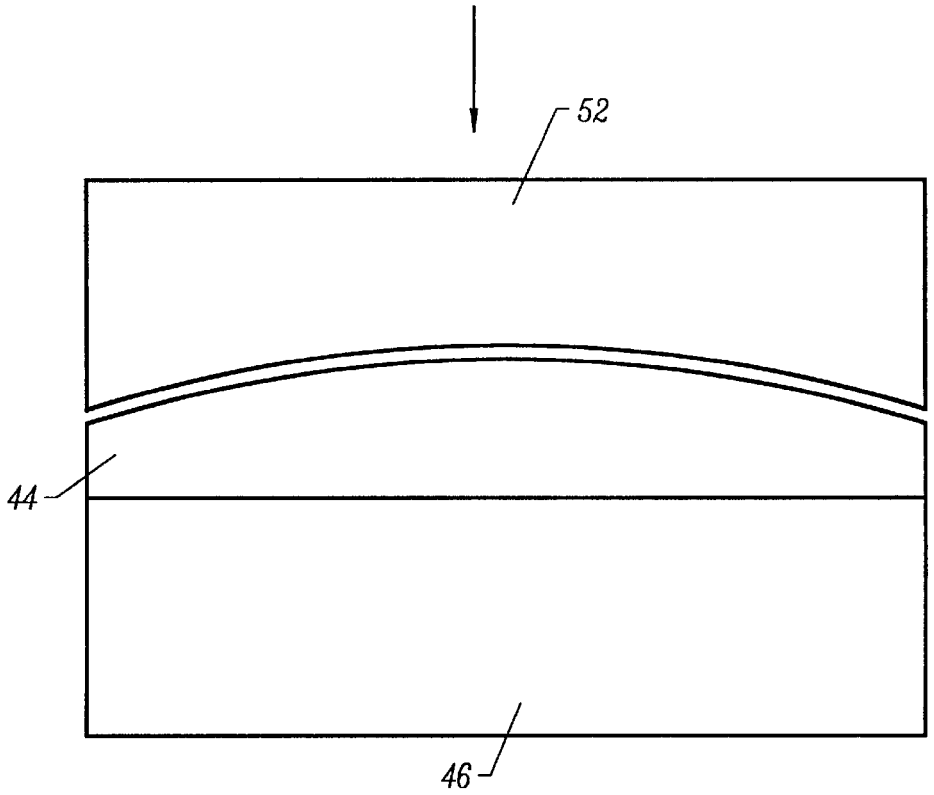
FIG. 6 PRIOR ART
FIG. 6 shows a side-sectional view of a cross-section of the carrier film of FIG. 5 sandwiched between the carrier film fixture and the carrier to deform the surface of the carrier film such that the surface conforms to the surface of the carrier film fixture.
Figure 11:
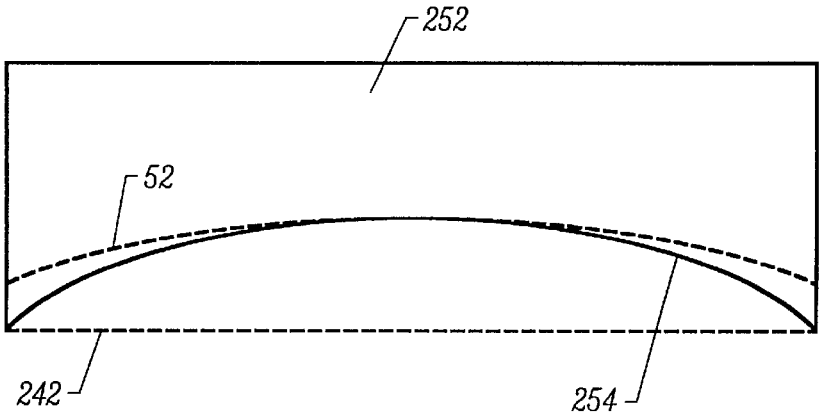
FIG. 11 shows an alternative embodiment of the inventive carrier film fixture having a surface that is characterized as a hyperboloid surface of rotation superimposed over a spheroid surface of rotation such as employed in the carrier film fixture of FIG. 5.

In an alternative embodiment of the present invention as shown in FIG. 11, a carrier film fixture 252 may have a surface 254 that may be characterized as a hyperboloid surface of rotation, i.e. if surface 254 were to revolve around a horizontal axis 242 shown by a dashed line, surface 254 would span the volume of a hyperboloid. In order to appreciate the change in surface geometry offered by fixture 152 relative to the fixture of the prior art, fixture 252 in FIG. 11 has been superimposed over prior art fixture 52 of FIG. 5 represented by phantom lines. Note that hyperboloid section makes a sharper imprint in tool 252 than does the spheroid section.

Before chemi-mechanical polishing begins, the tooling equipment necessary for polishing may employ a carrier film tool as in FIGS. 10 and 11 to shape a carrier film. Surface 154 of fixture 152, as shown in FIG. 10, will be used as an exemplar to set forth the process of tooling according to one embodiment of the present invention.

Figure 12:
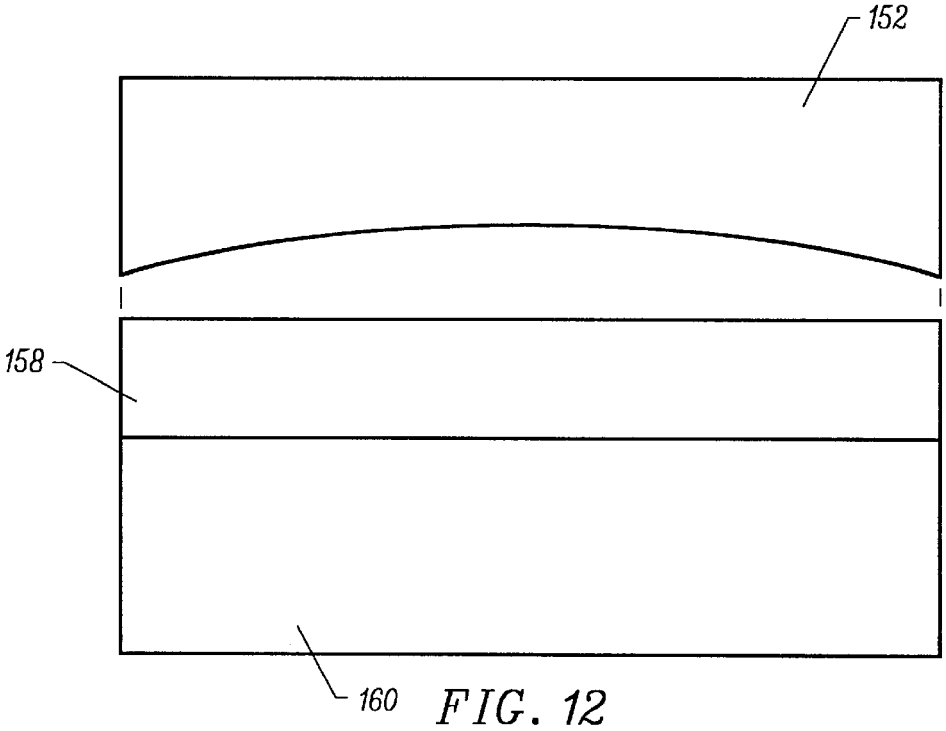
FIG. 12 shows one embodiment of the inventive carrier film fixture of FIG. 10 positioned above an assembly of a carrier film and a carrier.

Referring to FIG. 12, carrier film fixture 152 is positioned above an assembly of a carrier 160 and a carrier film 158. Carrier 160 is typically constructed from stainless steel and has a planar top surface. Carrier film 158 is typically constructed from a deformable thermoplastic compressible material such as polyvinyl chloride, polyvinyl acetate and nylon. The assembly of carrier film 158 and carrier 160, as shown in FIG. 12, is generally formed by gluing carrier film 158 to carrier 160.

Figure 13:
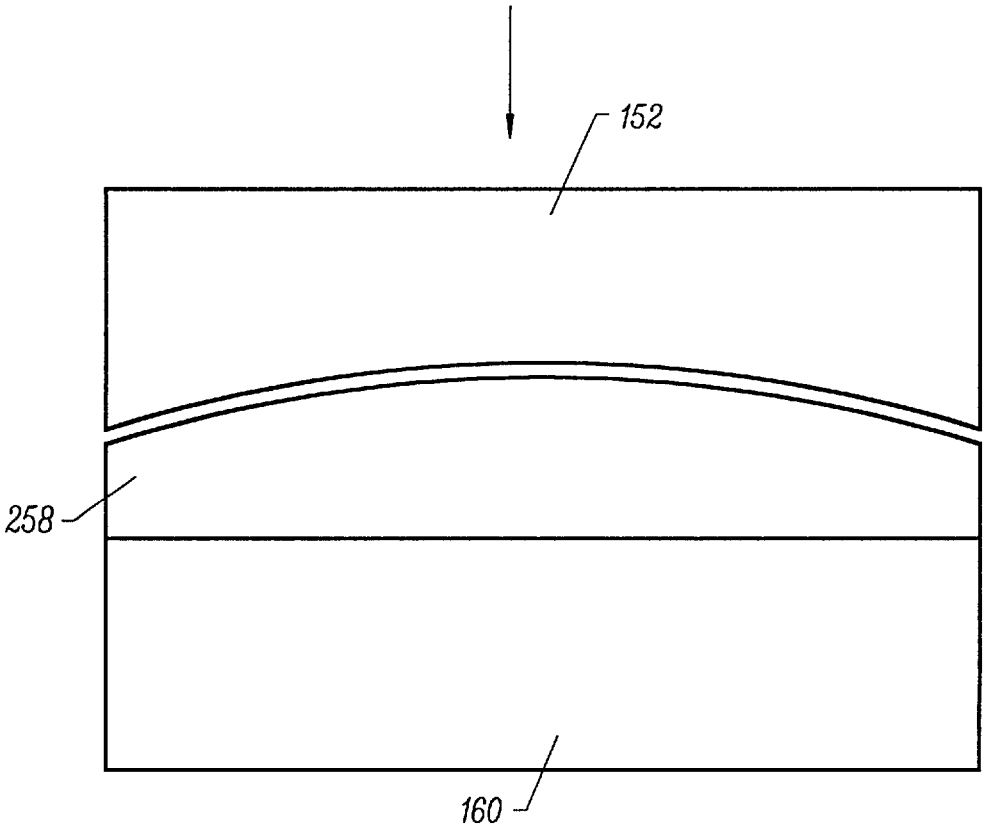
FIG. 13 shows the carrier film is sandwiched between the carrier and the carrier film fixture to deform the surface of the carrier film such that it conforms to the surface of the carrier film fixture.

As shown in FIG. 13, carrier film 258 is then sandwiched between carrier 160 and fixture 152 such that the adhesion of carrier film 258 to carrier 160 is further facilitated. Under significant pressures. i.e. typically between about 50 and about 60 psi and at fairly high temperatures. i.e. typically between about 150° and about 250° C., the surface of the carrier film 258 deforms to acquire a shape conforming to the surface of fixture 152 such that surface of carrier film 258 protrudes out by a distance that corresponds to the recessed distance in the surface of fixture 152. As a result, the geometry of the surface of carrier film 158 may also may be characterized as an oblate-spheroid surface of rotation. The curvature introduced into the surface of carrier film 258 has been exaggerated in FIG. 13 for purposes of illustration. For a carrier film that is about 1.5 mm thick, for example, the bow introduced is typically less than 50 m.

Figure 1:
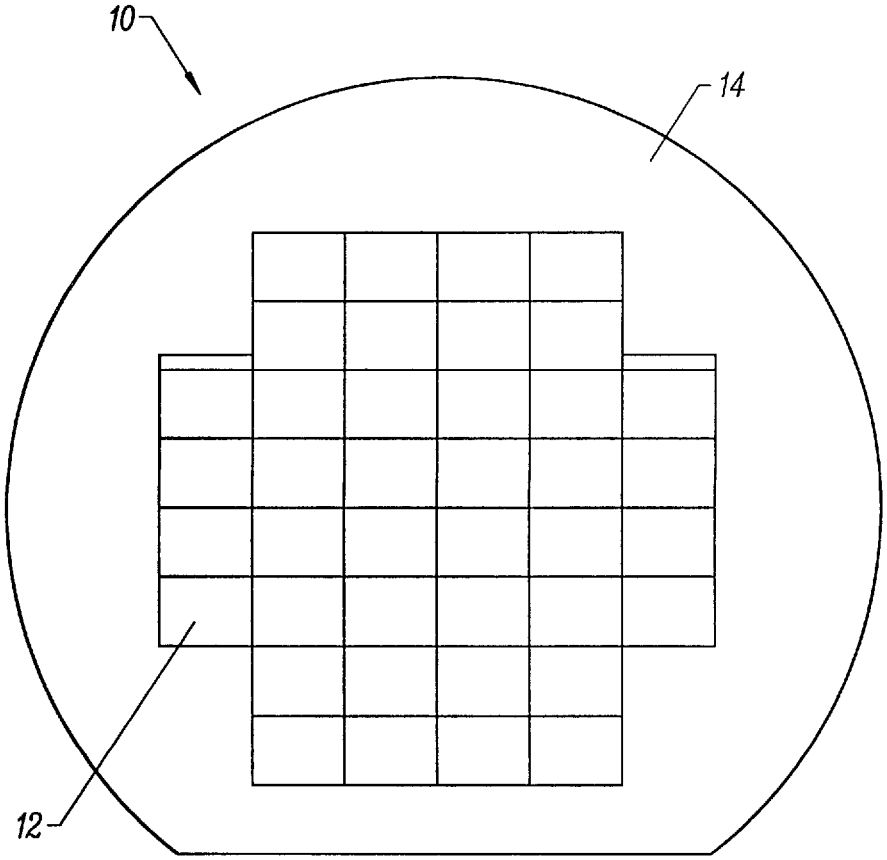
FIG. 1 PRIOR ART
FIG. 1 is a top view of a typical semiconductor wafer surface having a die area and a guardband area.
Figure 2:
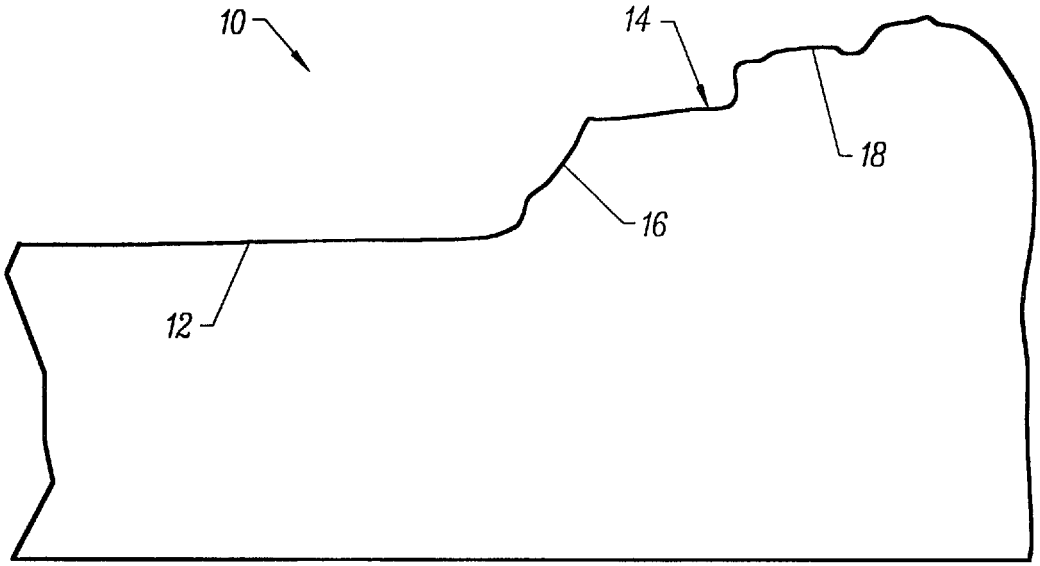
FIG. 2 PRIOR ART
FIG. 2 is a side-sectional view of a cross-section of the wafer surface, as shown in FIG. 1, showing build-up at the guardband area.
Figure 3:
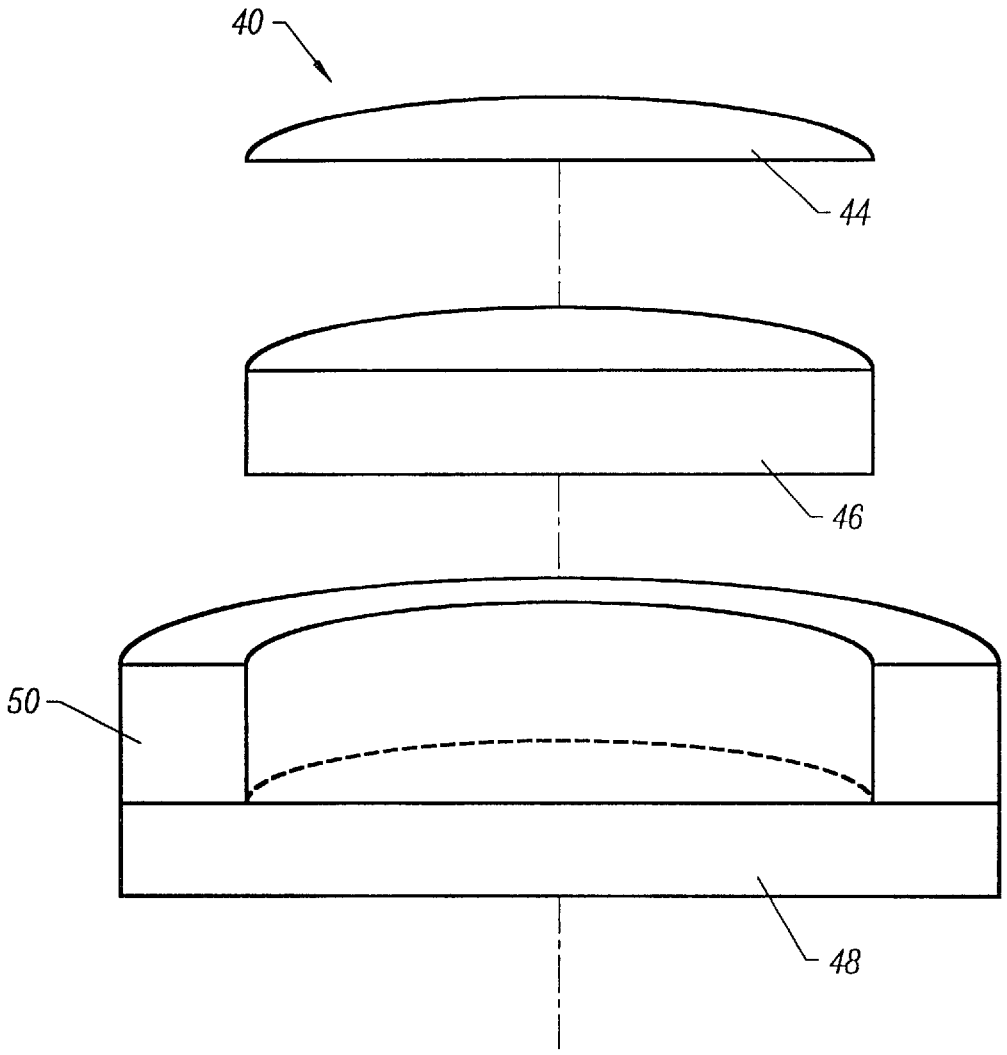
FIG. 3 PRIOR ART
FIG. 3 is an exploded side-sectional view of the significant components in a wafer holder assembly generally employed during chemi-mechanical polishing for holding the wafer as shown in FIGS. 1 and 2.
Figure 4:
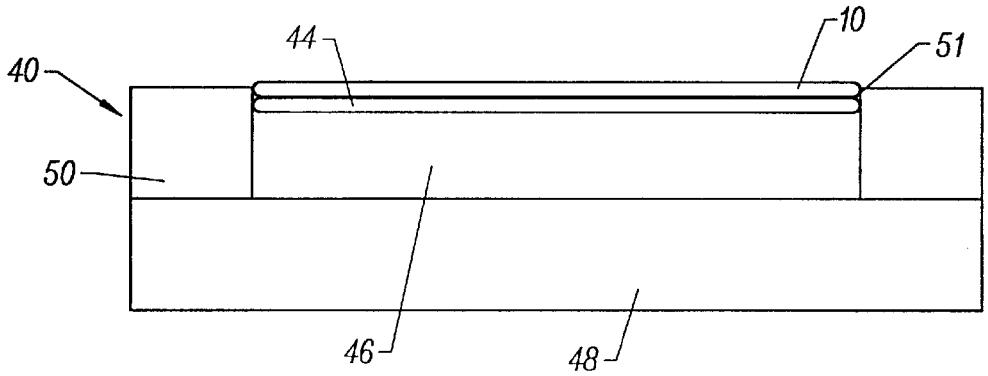
FIG. 4 PRIOR ART
FIG. 4 shows the side-sectional view of an assembled wafer holder of FIG. 3 holding the wafer of FIGS. 1 and 2.
Figure 14:
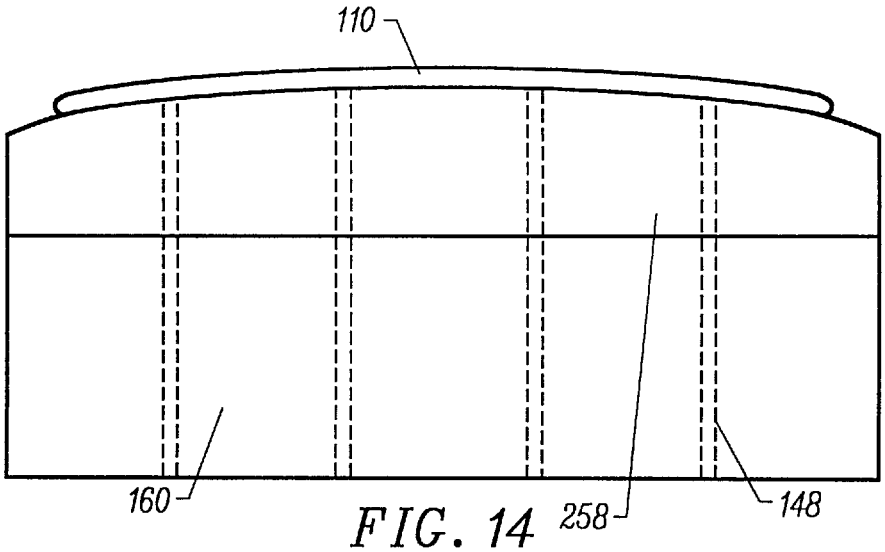
FIG. 14 shows a substrate secured on and conforming to the surface of the carrier film of FIG. 13, facilitated by vacuum holes that are generally connected to a vacuum source.

FIG. 14 shows a substrate 110 disposed above and conforming to the surface of carrier film 158. Generally, substrate 110 may include any material to be polished. In preferred embodiments, however, substrate 110 is a semiconductor wafer. Substrate 110 may be secured on carrier film 258 by pulling a vacuum through vacuum holes 248, which typically include about 50 tiny holes that are connected to a vacuum source (not shown for simplifying illustration). The assembly shown in FIG. 14 may then be incorporated into a wafer holder assembly, which was described above in detail with reference to FIGS. 3 and 4. Base plate 48 and ring 50, as shown in FIG. 3, may be constructed from stainless steel and nylon, respectively. In operation, the wafer holder assembly is typically oriented upside down in comparison with the orientation shown in FIGS. 3 and 4. Thus, the substrate surface to be polished faces down and contacts a polishing pad that is facing up.

Figure 7:
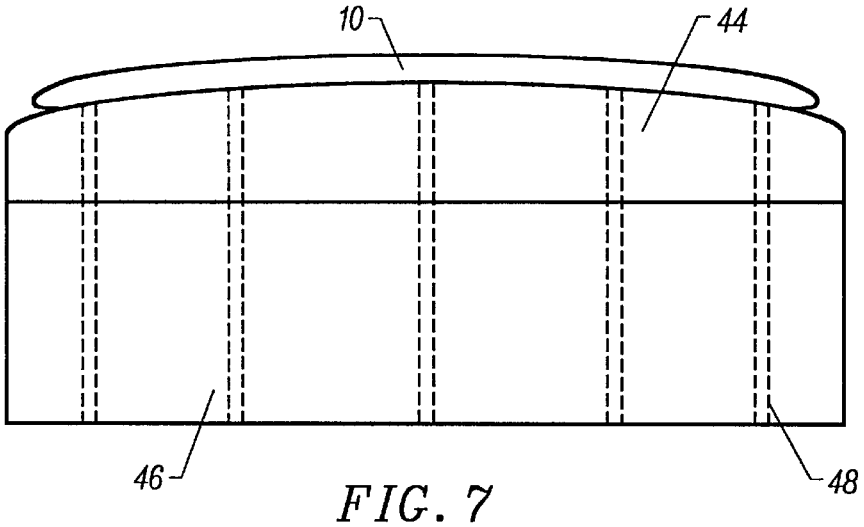
FIG. 7 PRIOR ART
FIG. 7 shows a side-sectional view of a cross-section of the wafer of FIGS. 1 and 2 secured on and conforming to the surface (exaggerated) of carrier film of FIG. 6 facilitated by vacuum holes that are generally connected to a vacuum source.
Figure 8:
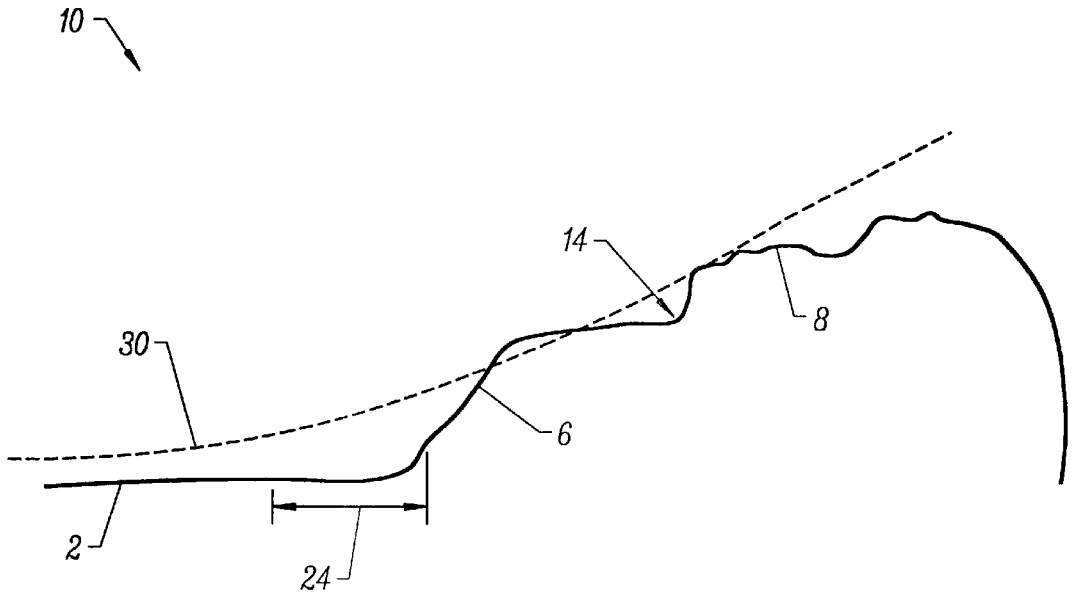
FIG. 8 PRIOR ART
FIG. 8 shows a side-sectional view of a cross-section of a wafer surface having a poorly polished region resulting from chemi-mechanical polishing as practiced in the prior art.
Figure 9:
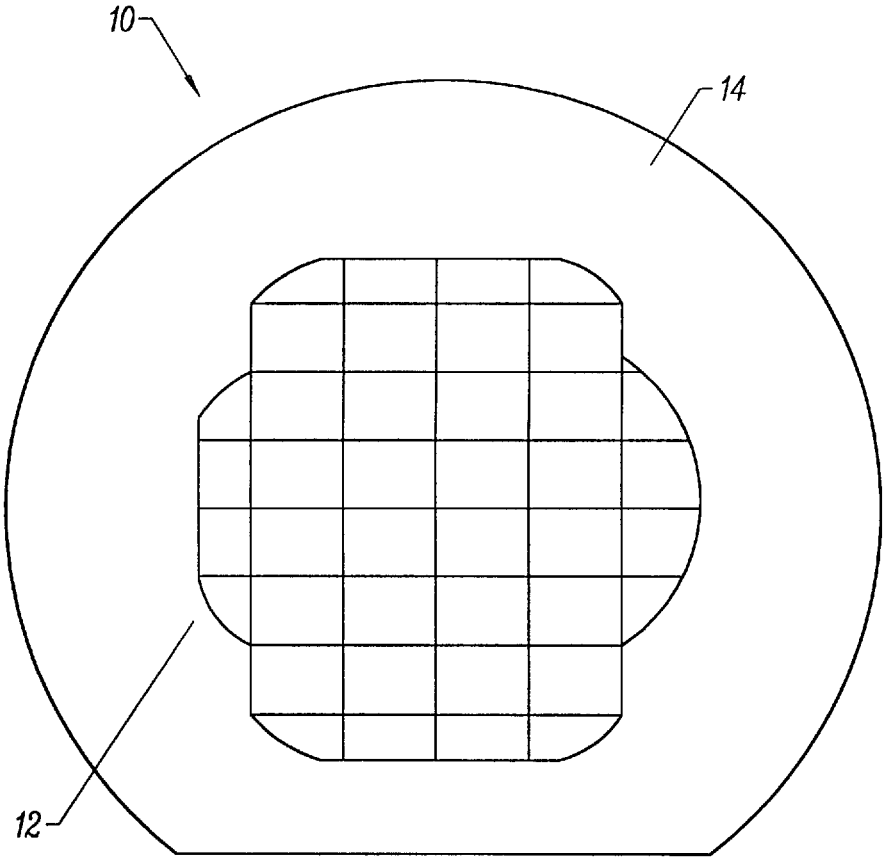
FIG. 9 PRIOR ART
FIG. 9 shows the top view of the surface of wafer in FIG. 8 and the dies in the perimeter of the wafer surface that have undergone degradation due to polishing by the prior art equipment and method.

Referring back to FIG. 14, substrate 110 as shown generally follows the surface of carrier film 258 and is deflected (bowed) by a smaller distance than it would be if resting on a spheroid section as shown in FIG. 7 of the prior art. Comparison of the oblate spheroid surface in carrier film 258 to a reference spheroid surface of the prior art carrier film 44, as shown in FIG. 5, illustrates that the surface carrier film 258 regresses from the reference surface near the perimeter.

Note that while FIG. 14 shows substrate 110 conforming exactly to the shape of the carrier film 258, this will often not be the case. As semiconductor wafers, for example, are quite rigid, they may not bend so far as to contact film 258 at all points along its surface. Often there will be some separation of substrate and film surface at the perimeter. Remember also that the film's curvature is generally exaggerated in the figures presented herein.

Figure 15:
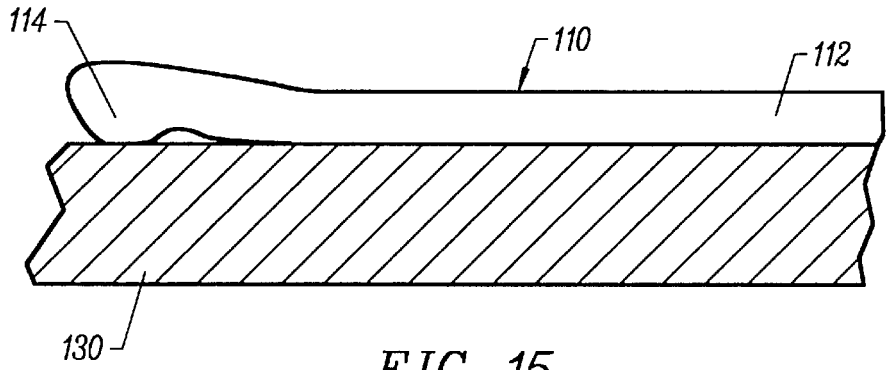
FIG. 15 shows a side-sectional view of a cross-section of a substrate surface that is being polished and conforming to the carrier film surface as shown in FIG. 14.

FIG. 15 further shows substrate 110 having a surface conforming to a carrier film 258 (located above substrate 110 and not shown for simplifying illustration) of FIG. 14, being polished by a polishing pad 130. As shown in FIG. 15, a portion of a guardband area 114 is being polished along with a die area 112 on the surface of substrate 110. As a result, in the oblate-spheroid geometry of the carrier film surface, the guardband area is being pushed into the polishing pad with greater force than with a pure spheroid geometry. Thus, the material build-up in the guardband area is selectively removed and the dies located in the perimeter of the substrate surface undergo polishing along with the dies located in the die area of the substrate surface. One skilled in the art would appreciate that by employing the oblate spheroid geometry, it may possible to polish down the build-up in the guardband area of the substrate surface using this carrier film surface geometry very quickly.

Figure 16:
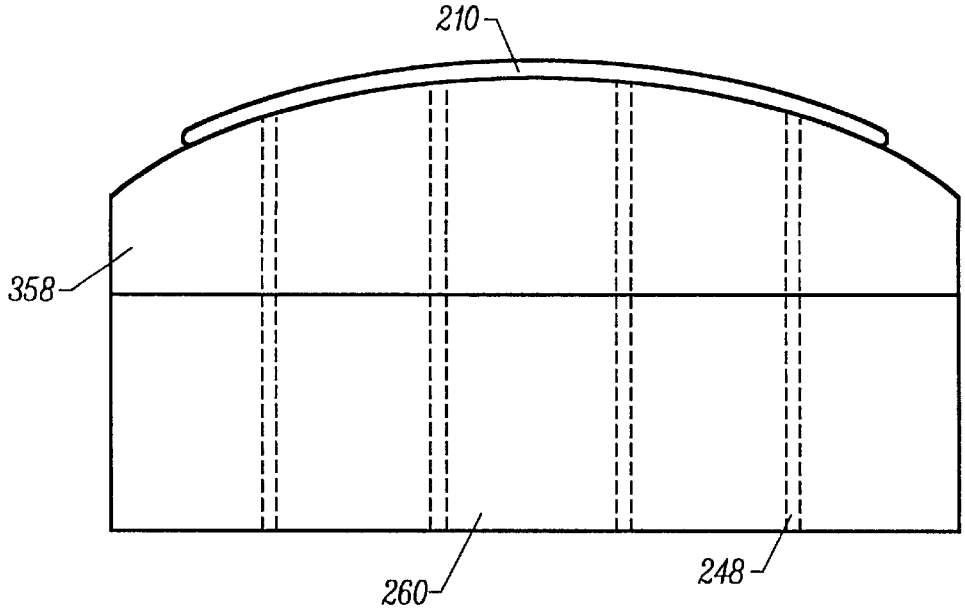
FIG. 16 shows a substrate secured on and conforming to the surface of the carrier film that is processed by the carrier film fixture of FIG. 11, facilitated by vacuum holes that are generally connected to a vacuum source.

According to another embodiment of the present invention, carrier film fixture 252 having a surface of hyperboloid surface of rotation, as shown in FIG. 11, may of course be similarly employed to process the carrier film and the carrier. By way of example, FIG. 16 shows a carrier film 358 disposed above a carrier 260 that is processed using a carrier film fixture 252 of FIG. 11. Referring to FIG. 16, a substrate 210 is disposed above and conforming (at least approximately) to the surface of carrier film 358. Wafer 210 is secured on carrier film 358 in this manner by vacuum holes 248, which are similar to holes 148 of FIG. 14.

Referring back to FIG. 16, substrate 210 closely follows the surface of carrier film 358 and is deflected by a greater distance than wafer 10 of FIG. 7 of the prior art. Comparison of the surface in carrier film 358 to a reference pure spheroid surface of the prior art carrier film 44, as shown in FIG. 5, illustrates that the curved surface carrier film 358 is more steeply curved toward the perimeter.

Figure 17:
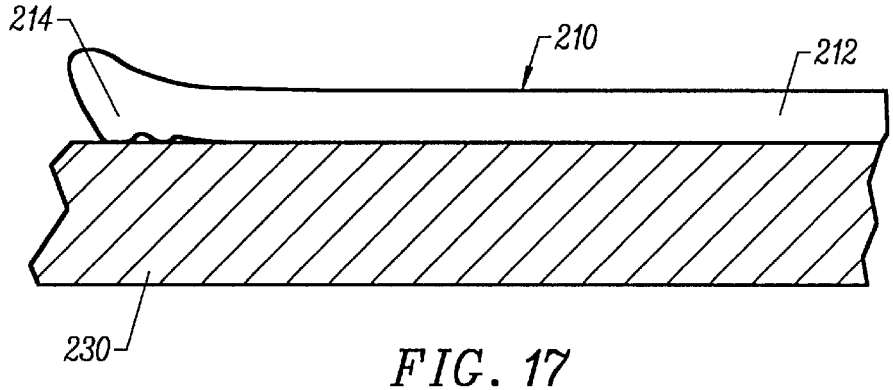
FIG. 17 shows a side-sectional view of a cross-section of a substrate surface that is being polished and conforming to the carrier film surface as shown in FIG. 16.

FIG. 17, further shows substrate 210 having a surface conforming to a carrier film 358 (located above substrate 210 and not shown for simplifying illustration) of FIG. 16, being polished by a polishing pad 230. According to this figure, mainly a die area 212 undergoes significant polishing, while a guardband area 214 is sufficiently deflected away from the polishing pad that it remains relatively unpolished. As a result, in the hyperboloid geometry of the carrier film surface, the dies located in the die area undergo polishing, while the residual material located in the guardband area remains unpolished. Thus, the non-spherical geometries, e.g. oblatespheroid and hyperboloid, of the carrier film fixture the and carrier film have a profound affect on the pressure loading of the wafer, which is stretched across the carrier film. It should be noted that the surfaces of the carrier film and its corresponding carrier film fixture in the present invention are not limited to an oblate-spheroid or a hyperboloid surface of rotation geometries, rather any other non-spherical geometry may be selected to apply more or less polishing force or the guardband region as described for particular applications. The exact mathematical description of the surface of rotation imprinted on the carrier film tool may of course vary with the application. The maximum indentation in the tool may also vary. By way of example, geometries of oblate-spheroid or hyperboloid that have maximum distortions of about 5 $\mu$m, typically work well.

By way of example, the carrier film fixture and its corresponding carrier film provide a great deal of flexibility during polishing, i.e. either the dies in the perimeter of the substrate surface are undergoing polishing or the dies in the die area of the substrate surface are undergoing significant polishing, while the dies is the guardband area of the substrate surface remain unpolished. One skilled in the art may appreciate that some empirical values may be calculated for the optimal carrier film surface geometry such that a substrate disposed above undergoes maximum polishing at its die area or undergoes polishing of the dies in the guardband area from the very beginning of the polishing process. It is important to note that in either geometry, the dies located in the perimeter of the substrate surface are not being degraded or being rendered inoperative as they are in the prior art.

Although the foregoing design has been described in some detail for purposes of clarity of understanding, it will be apparent that certain changes and modifications may be practiced within the scope of the appended claims. For example, the flexibility provided by the present invention may be used to polish substrates that contain features or devices other than those contained on IC wafers. Therefore, the present embodiments are to be considered as illustrative and not restrictive, and the invention is not to be limited to the details given herein, but may be modified within the scope of the appended claims.

What is claimed is:

1. A substrate holder assembly for immobilizing an integrated circuit (IC) wafer during polishing, said substrate holder comprising:

a base plate having a substantially planar surface sized to support said integrated circuit (IC) wafer;

a circumferential restraint member arranged with respect to the base plate to engage the IC wafer's edges; and a carrier assembly disposed above said substantially planar surface of said base plate and below said IC wafer, said carrier assembly including a film having a surface that is characterized by a substantially oblate spheroid or non-spherical hyperboloid surface of rotation, wherein during polishing said surface of said film supports said IC wafer in a manner causing said IC wafer to bow according to said surface of rotation.

2. The substrate holder assembly of claim 1, wherein said film includes a thermoplastic compressible material.

3. The substrate holder assembly of claim 1, wherein said thermoplastic compressible material comprises one selected from a group consisting essentially of polyvinyl chloride, polyvinyl acetate and nylon.

4. The substrate holder assembly of claim 1, further comprising a plurality of openings that are capable of maintaining a vacuum such that if said substrate contacts said film, said substrate is held tightly enough against said film to bow according to said surface of rotation of said film, wherein said openings extend from said base plate, through said carrier and to said film.

5. A carrier film tool having a surface that is characterized by a substantially oblate-spheroid or hyperboloid surface of rotation, said carrier film tool effectively shapes the surface of a deformable material to produce a film for supporting an IC wafer in a wafer holder used to immobilize said IC wafer during polishing, said carrier film tool shaping said film to have a film surface corresponding to said substantially oblate-spheroid or non spherical hyperboloid surface of rotation of said carrier film tool.

6. A process of forming a film having a surface that is characterized by a substantially oblate-spheroid or hyperboloid surface of rotation, said film capable of supporting an IC wafer in a wafer holder used to immobilize said IC wafer during polishing, said process comprising:

providing a deformable film;

bringing said film in contact with a surface of a carrier film tool, wherein said surface of said tool is characterized by a substantially oblate-spheroid or non-spherical hyperboloid surface of rotation;

applying pressure on said surface of said tool and against said film such that the surface of said film acquires a shape that corresponds to said surface of rotation of said tool.

7. The process of claim 6, further comprising a step of providing said film on a carrier prior to bringing said film in contact, wherein said film is disposed above said carrier.

8. The process of claim 7, further comprising a step of gluing said carrier to said film, wherein said step of gluing comes before said step of providing said film.

9. The process of claim 6, wherein said step of applying pressure on said surface of said tool sandwiches said film between said tool and said carrier.

10. The process of claim 6, wherein said step of applying pressure comprises applying a pressure of between about 50 and about 60 psi.

11. The process of claim 6, wherein said step of applying pressure comprises maintaining a temperature of between about 150° and about 200° C.

12. A process of polishing a substrate, comprising:

mounting said substrate in a substrate holder assembly, said substrate holder assembly comprises a base plate having a substantially planar surface sized to support said integrated circuit (IC) wafer, a circumferential restraint member arranged with respect to the base plate to engage the IC wafer's edges, and a carrier assembly disposed above said substantially planar surface of said base plate and below said IC wafer, said carrier assembly including a film having a surface that is characterized by a substantially oblate spheroid or non spherical hyperboloid surface of rotation, wherein during polishing of the substrate said surface of said film supports said IC wafer in a manner causing said IC wafer to bow according to said surface of rotation; and contacting a substrate with a polishing pad against the surface of said substrate, to thereby polish said substrate.

13. The process of claim 12, wherein said step of mounting comprises mounting said substrate in said substrate holder assembly such that said substrate holder assembly holds said wafer facing down and contacting said polishing pad facing up.

14. The process of claim 12, wherein said step of contacting the substrate comprises contacting a guardband region along the periphery of said substrate along with a die region of said substrate.

15. The process of claim 12, wherein said step of contacting the substrate comprises contacting a die region of said substrate without substantially contacting a guardband region along the periphery of said substrate.

16. A substrate holder assembly for polishing a substrate used to fabricate one or more ICs, said substrate holder comprising:

base plate means for providing support to a substrate;

means to hold said substrate at the edges disposed above said base plate; and a carrier film disposed above said base plate means and having a convex surface that protrudes outwardly and is characterized as a non-spherical surface of rotation, wherein said surface of said film holds a substrate during polishing of the substrate.

17. The substrate holder assembly of claim 16, wherein said base plate comprises stainless steel.

18. The substrate holder assembly of claim 16, wherein said means to hold comprises nylon.

19. The substrate holder assembly of claim 16, wherein said film comprises a thermoplastic compressible material.

20. The substrate holder assembly of claim 19, wherein said thermoplastic compressible material comprises one selected from a group consisting essentially of polyvinyl chloride, polyvinyl acetate and nylon.

21. The substrate holder assembly of claim 16, further comprising a carrier means supporting said film and disposed within said means to hold said substrate.

22. The substrate holder assembly of claim 21, wherein said carrier means comprises stainless steel.

23. The substrate holder assembly of claim 21, wherein said carrier means includes a planar top surface.

* * * * *